US008596520B2

(12) United States Patent
Scott

(10) Patent No.: US 8,596,520 B2
(45) Date of Patent: Dec. 3, 2013

(54) WATERPROOF AND ANTI-WICKING CORRUGATED CONTAINER

(75) Inventor: Terry Scott, Olympia, WA (US)

(73) Assignee: International Paper Co., Memphis, TN (US)

( * ) Notice: Subject to any disclaimer, the term of this patent is extended or adjusted under 35 U.S.C. 154(b) by 3 days.

(21) Appl. No.: 13/447,586

(22) Filed: Apr. 16, 2012

(65) Prior Publication Data

US 2013/0270333 A1 Oct. 17, 2013

(51) Int. Cl.
*B65D 5/68* (2006.01)
*B65D 43/08* (2006.01)

(52) U.S. Cl.
USPC ..... 229/125.19; 229/939; 229/941

(58) Field of Classification Search
USPC ..... 229/125.19, 186, 198.2, 939, 941
See application file for complete search history.

(56) References Cited

U.S. PATENT DOCUMENTS

| | | | | |
|---|---|---|---|---|
| 1,583,381 | A | | 5/1926 | Zimmerman |
| 1,592,824 | A | | 7/1926 | Fairchild |
| 1,863,706 | A | | 6/1932 | Wood, Sr. |
| 3,015,596 | A | | 1/1962 | Couch et al. |
| 3,307,994 | A | | 3/1967 | Scott, Jr. |
| 3,406,052 | A | | 10/1968 | Peters |
| 3,864,200 | A | | 2/1975 | Marshall |
| 3,902,651 | A | | 9/1975 | Marshall |
| 3,962,509 | A | | 6/1976 | Thompson |
| 3,972,270 | A | | 8/1976 | Marshall |
| 3,973,476 | A | | 8/1976 | Marshall |
| RE29,272 | E | | 6/1977 | Hintz et al. |
| 4,778,696 | A | | 10/1988 | King |
| 4,802,620 | A | | 2/1989 | Phillips |
| 4,826,714 | A | | 5/1989 | King |
| 4,892,223 | A | | 1/1990 | Dement |
| 5,009,326 | A | * | 4/1991 | Reaves et al. ..... 229/103.11 |
| 5,201,868 | A | * | 4/1993 | Johnson ..... 229/103.11 |
| 5,211,134 | A | | 5/1993 | Bolo, III |
| 5,303,675 | A | | 4/1994 | Van Den Bergh |
| 5,411,204 | A | | 5/1995 | DeMay |
| 5,626,945 | A | | 5/1997 | Berzins et al. |
| 5,794,843 | A | * | 8/1998 | Sanchez ..... 229/403 |
| 5,810,243 | A | | 9/1998 | DiPinto et al. |
| 5,830,320 | A | | 11/1998 | Park et al. |
| 5,847,011 | A | | 12/1998 | Terado et al. |
| 6,073,760 | A | * | 6/2000 | Roemer et al. ..... 229/125.19 |
| 6,338,234 | B1 | | 1/2002 | Muise et al. |

(Continued)

FOREIGN PATENT DOCUMENTS

| | | |
|---|---|---|
| EP | 1143868 | 11/2004 |
| GB | 1142773 | 2/1969 |
| WO | 2004045971 | 6/2004 |
| WO | 2004089764 | 10/2004 |

*Primary Examiner* — Gary Elkins
(74) *Attorney, Agent, or Firm* — Matthew M. Eslami

(57) ABSTRACT

A waterproof, anti-wicking, and fully recyclable corrugated container comprises a base portion having a bottom wall, a pair of opposite side walls, a pair of opposite end walls, and a plurality of joined flaps foldably joined with the side walls and the end walls. Each of the plurality of the joined flap folds onto itself to form a gusset that is attached to the respective side walls. A lid portion is telescopically engaged over the base portion such that is coextensive in length and width with the base portion side walls and end walls. The lid portion comprises a score or crease line formed along near free edge of the side walls to inhibit liquid from traveling up through the side walls.

3 Claims, 6 Drawing Sheets

(56) References Cited

U.S. PATENT DOCUMENTS

| | | | | |
|---|---|---|---|---|
| 6,450,398 | B1 | 9/2002 | Muise et al. | |
| 6,541,556 | B1 | 4/2003 | Berube | |
| 6,846,573 | B2 | 1/2005 | Seydel | |
| 7,155,746 | B2 | 1/2007 | Schorr et al. | |
| 7,244,509 | B1 | 7/2007 | Seydel | |
| 7,648,772 | B2 | 1/2010 | Grant et al. | |
| 2003/0124316 | A1 | 7/2003 | Huang et al. | |
| 2010/0189961 | A1 | 7/2010 | Bugas et al. | |
| 2010/0230062 | A1 | 9/2010 | Attal | |
| 2011/0065557 | A1 | 3/2011 | Hirschey | |
| 2011/0138753 | A1* | 6/2011 | Justice et al. | 229/103.11 |
| 2011/0220306 | A1 | 9/2011 | Propst, Jr. et al. | |
| 2011/0244258 | A1 | 10/2011 | Vonfelden | |
| 2011/0259945 | A1* | 10/2011 | DeJong et al. | 229/100 |

* cited by examiner

WATERPROOF AND ANTI-WICKING CORRUGATED CONTAINER

FIELD OF THE INVENTION

The present invention relates generally to a waterproof corrugated container and more particularly, to a waterproof, anti-wicking, and recyclable corrugated container.

BACKGROUND OF THE INVENTION

Corrugated paperboard containers are used to store and transport a variety of goods. It has been common practice for many years to ship meat, poultry, fish, and produce contained in such corrugated containers. Sometimes, corrugated containers are used in very wet conditions or even contain standing water when packaging goods such as fish or other goods that are damp or shipped on ice. Problems thus have been encountered since untreated paperboard often got soft and pulpy after contact with water and moisture, therefore affecting the structural integrity of the container. In attempting to develop improved corrugated container, it was found that by applying petroleum-based waxes, or polyethylene or other polymer compositions to the walls of container can overcome the aforementioned problem. Although these materials provide acceptable performance, they are subject to environmental concerns. Specifically, wax or many polymers when laminated or extruded to packaging, make these materials non-recyclable.

Therefore, it would be desirable to provide a waterproof, anti-wicking, and fully recyclable corrugated container, which is simple in form, and which does not increase material and manufacturing costs.

SUMMARY OF THE INVENTION

The waterproof, anti-wicking, and fully recyclable corrugated container has waterproof liners on the inner sides and outer side of the walls of the container to prevent liquids such as water from reaching the corrugation medium from both inner and outer sides. The waterproof container is particularly suitable for products that are damp or shipped on ice such as fish, lobster or shrimp and the like and can be in contact with standing water for an extended time and/or can in a very wet environment. A score/crease (crushed) line is formed perpendicular to the flutes near the edge of the lid portion to prevent water wicking when the container is sitting in standing water. The crushed line or pinched points substantially reduces the size of the flute opening and decreases the depth of which water that will under normal conditions rise to, when seeking its own level. The smaller flute opening at the crease line causes the water to stay lower in the flute than the depth of the water outside the container by use of water pressure characteristics (i.e., static head pressure). This is a two piece container comprised of a lid portion and a base portion that are known as gusseted Display Style Tray (DST). A gusseted DST has no cuts or slots in the body. In the present invention the lid is the piece with the crease or crushed point positioned near the bottom of the package when is telescopically engaged with the base. The base has no crease or crushing point at its top edge, however, one of skilled in the art would appreciate that the base may have crease line as well depending on the usage of the container.

Accordingly, one aspect of the present invention is directed to a waterproof, anti-wicking, and fully recyclable corrugated container that comprises a base portion having a bottom wall, a pair of opposite side walls, a pair of opposite end walls, and a plurality of joined flaps foldably joined with the side walls and the end walls. Each of the plurality of the joined flap folds onto itself to form a gusset that is attached to the respective side walls. A lid portion is telescopically engaged over the base portion such that is coextensive in length and width with the base portion side walls and end walls. The lid comprises a top wall, a pair of opposite side walls, a pair of opposite end walls, and a plurality of joined flaps foldably joined with the side walls and the end walls. Each of the plurality of the joined flaps folds onto itself to form a gusset that is attached to the respective side walls of the lid. The lid portion comprises a score or crease line formed along near free edge of the side walls to inhibit liquid from traveling up through the side walls. Each of the side walls of the lid is defined by corrugation medium adhesively interposed inner and outer liners. The corrugation medium and inner and outer liners are made of waterproof, anti-wicking, and fully recyclable materials.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
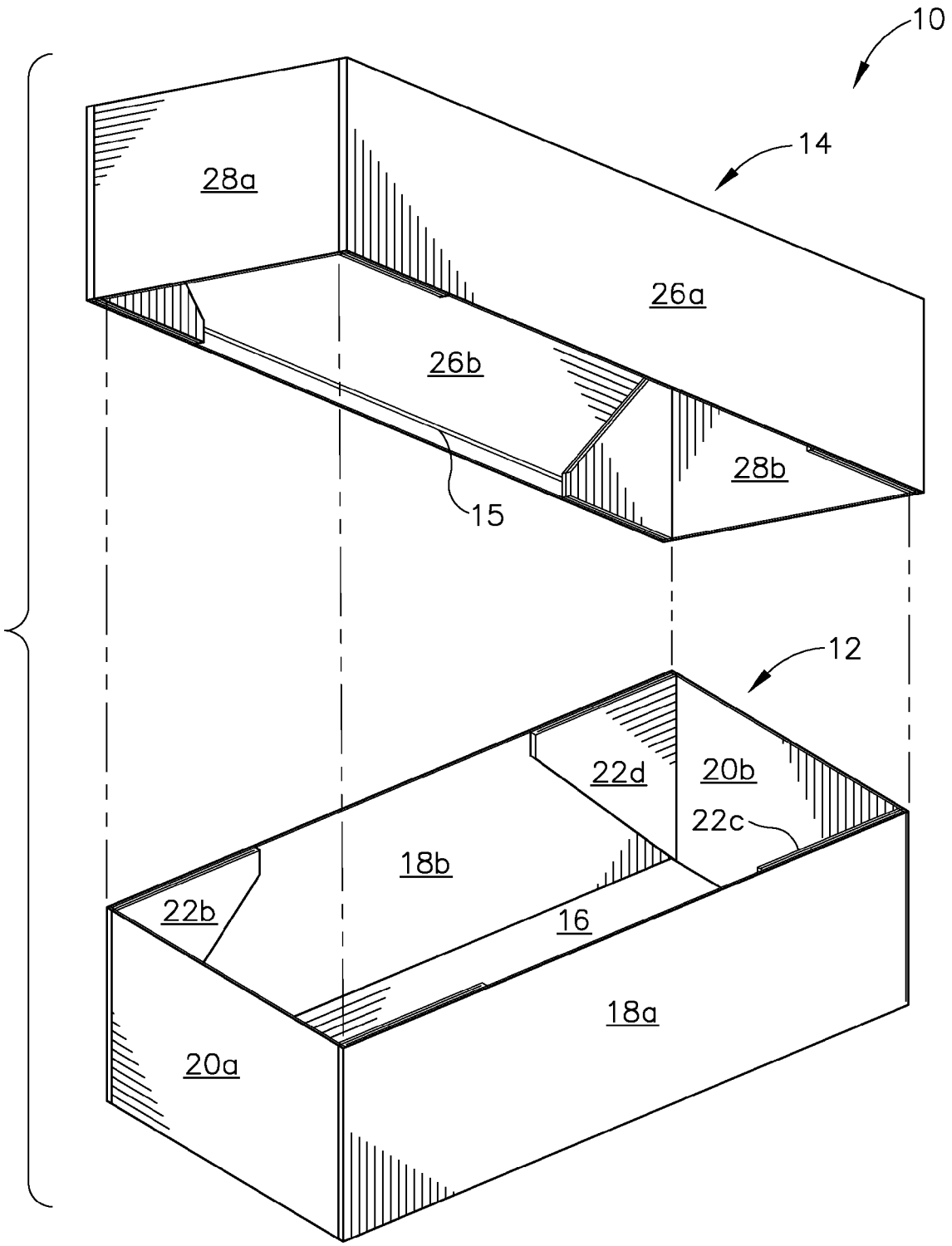
FIG. 1 is an exploded perspective view of a waterproof, anti-wicking, and recyclable corrugated container defined by a base portion and a lid portion illustrated in a spaced relationship with one another in accordance to the preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2:
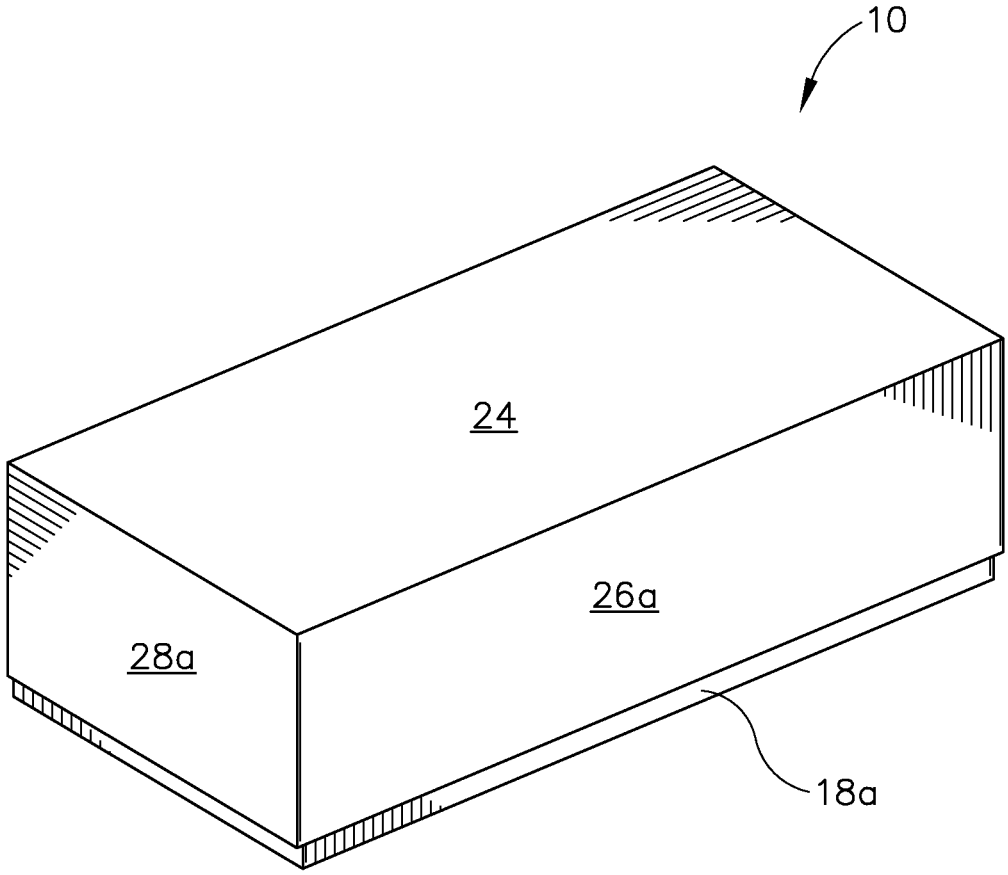
FIG. 2 is similar to FIG. 1 depicting the lid portion is telescopically fit over the base portion.
Figure 6:
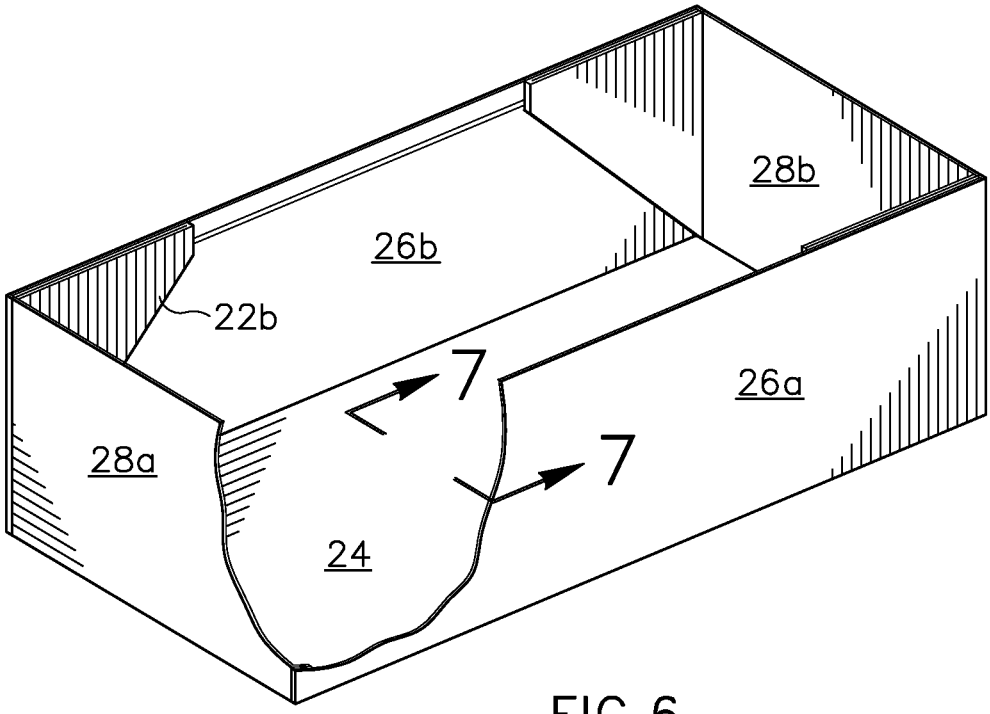
FIG. 6 is a top perspective view of the lid in FIG. 5 with a portion of lid is removed to illustrate a score or crease is formed perpendicular to the flutes near the edge of the lid to prevent water traveling up when the container is sitting in standing water.

FIG. 1 is an exploded perspective view of a waterproof, anti-wicking, and recyclable corrugated paperboard container 10 defined by a base portion 12 and a lid portion 14 illustrated in a spaced relationship with one another in accordance to the preferred embodiment of the invention. It should be noted that the container 10 is a two piece box comprised of a base portion 12 and a lid portion 14 that are gusseted-design style tray. Generally, the gusseted design style tray has no cuts or slots in their respective body. The base portion 12 and the lid portion 14 are substantially the same with two exceptions: 1) the base portion 12 is slightly smaller than the lid portion 14 so that the lid portion 14 can be telescopically fit over the base portion 12 and 2) the lid 14 includes a score or crease line 15 formed perpendicular to the flutes direction near the edge of side walls 26*a*, 26*b* of the lid 14 to prevent water traveling up through the side walls when the container 10 is sitting in standing water as will be discussed hereinafter in greater detail. The base 12 is of rectangular configuration with a bottom wall 16, opposed parallel sidewalls 18*a*, 18*b*, opposed parallel end walls 20*a*, 20*b* closing the bottom of the base 10. Each of the respective end walls 20*a*, 20*b* includes two joined flaps 22*a*', 22*b*' and 22*c*', 22*d*' each of which extends foldably from lateral edge of the respective end walls 20*a*, 20*b*. The joined flaps 22*a*', 22*b*' and 22*c*', 22*d*' foldably connect the end walls 20*a*, 20*b* to the sidewalls or vice versa. Similarly, the lid portion 14 is of rectangular configuration with a top wall 24, opposed parallel sidewalls 26*a*, 26*b*, opposed parallel end walls 28*a*, 28*b* enclosing the lid 14. Each of the respective end walls 28*a*, 28*b* includes two joined flaps 22*a*, 22*b* and 22*c*, 22*d* each of which extends foldably from lateral edge of the respective end walls 28*a*, 28*b*. The joined flaps 22*a*, 22*b* and 22*c*, 22*d* foldably connect the end walls 28*a*, 28*b* to the sidewalls or vice versa. The score or crease line 15 is formed along near the free edge of the side walls 26*a*, 26*b*. The score or crease line 15 begins at one longitudinal end of the respective side wall 26*a*, 26*b* and extends to the other longitudinal end of the respective side wall 16*a*, 26*b* which pinch or crush the liner boards and corrugation board to one another as illustrated in FIG. 6. As seen best in FIG. 2, the lid portion 14 entirely covers the base portion 12 which extends the length and width of the base and is coextensive in length and width with the base side walls and end walls.

Figure 3:
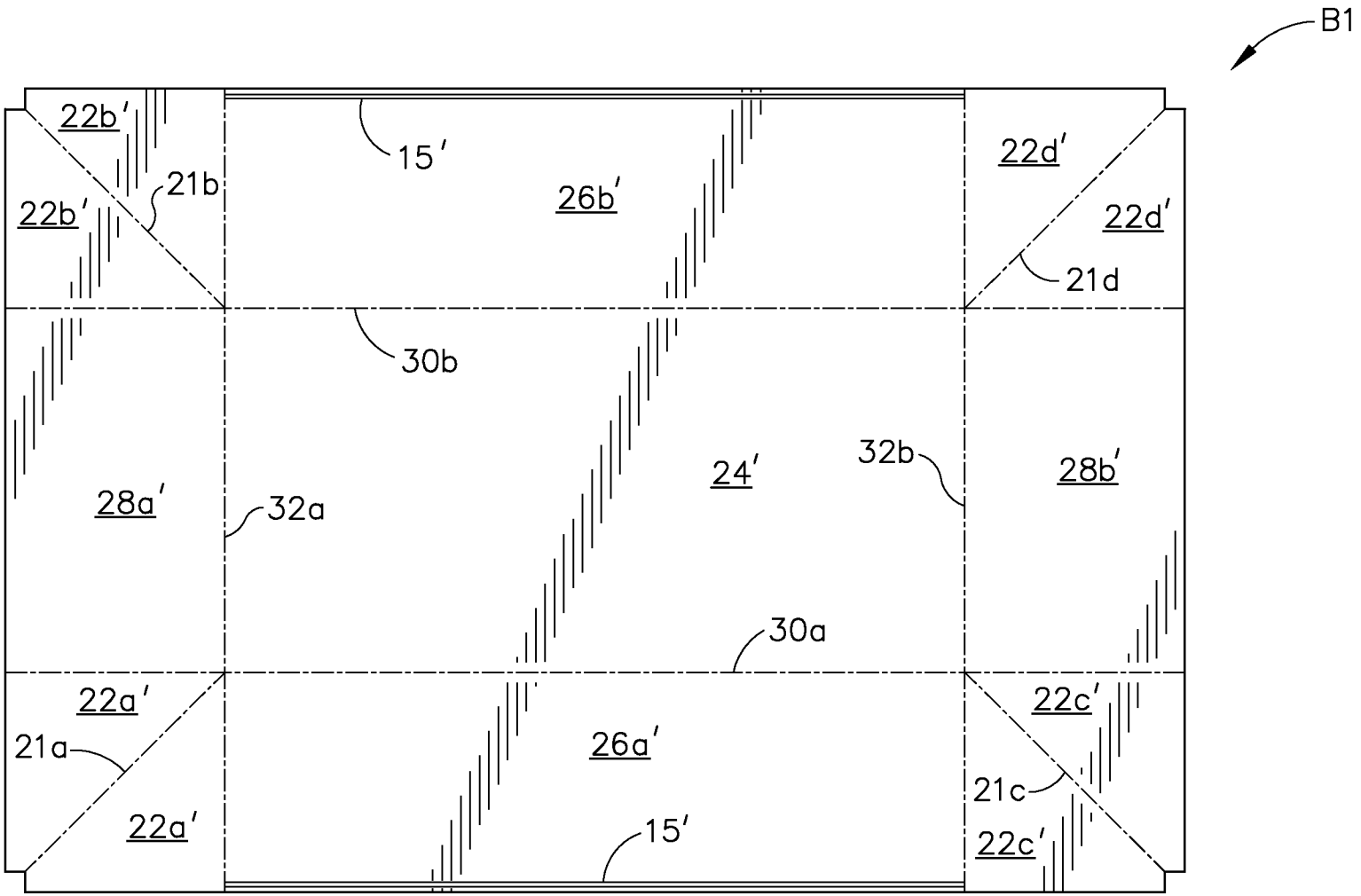
FIG. 3 is a top plan view of a blank B1 for making the lid portion of container in FIG. 1 in accordance to a preferred embodiment of the present invention.

FIG. 3 is a top plan view of a blank B1 for making the lid portion 14 of container 10 in FIG. 1 in accordance to a preferred embodiment of the present invention. The blank B1 is substantially flat symmetrical with respect to its longitudinal axis thereof. The blank B1 is preferably an integral piece of a material such as continuous sheet of conventional corrugated paperboard. The blank B1 is cut along its outer margins to form its specific shape of a gusseted design style tray or lid when fully constructed. The blank B1 is divided into top wall panel 24', side wall panels 26*a*', 26*b*', end wall panels 28*a*', 28*b*', and joined flaps 22*a*, 22*b* and 22*c*, 22*d* by two longitudinal parallel fold lines 30*a*, 30*b*, and two lateral parallel fold lines 32*a*, 32*b* intersecting one another. Each of the joined flaps 22*a*, 22*b* and 22*c*, 22*d* is further divided by respective diagonal fold lines 21*a*, 21*b*, 21*c*, and 21*d* which permits each flap folds onto itself to form a respective gusset when the blank B1 is fully constructed. Although the blank B1 is characterized as having side panels and end panels, but one of the ordinary skilled in the art would appreciate that the end panels can be defined as side panels as well and the characterization of the side panels and end panels have no effect on the function or utility of the blank B1. The blank B1 is formed from a corrugation medium 34 sandwiched between two liners 36*a*, 36*b* as seen best in FIG. 6 as will be discussed hereinafter. The score or crease line 15 is formed on the inner side of the side wall panels 26*a*' and 26*b*' and its length is the same as longitudinal length of the side walls 26*a*' and 26*b*'.

Figure 4:
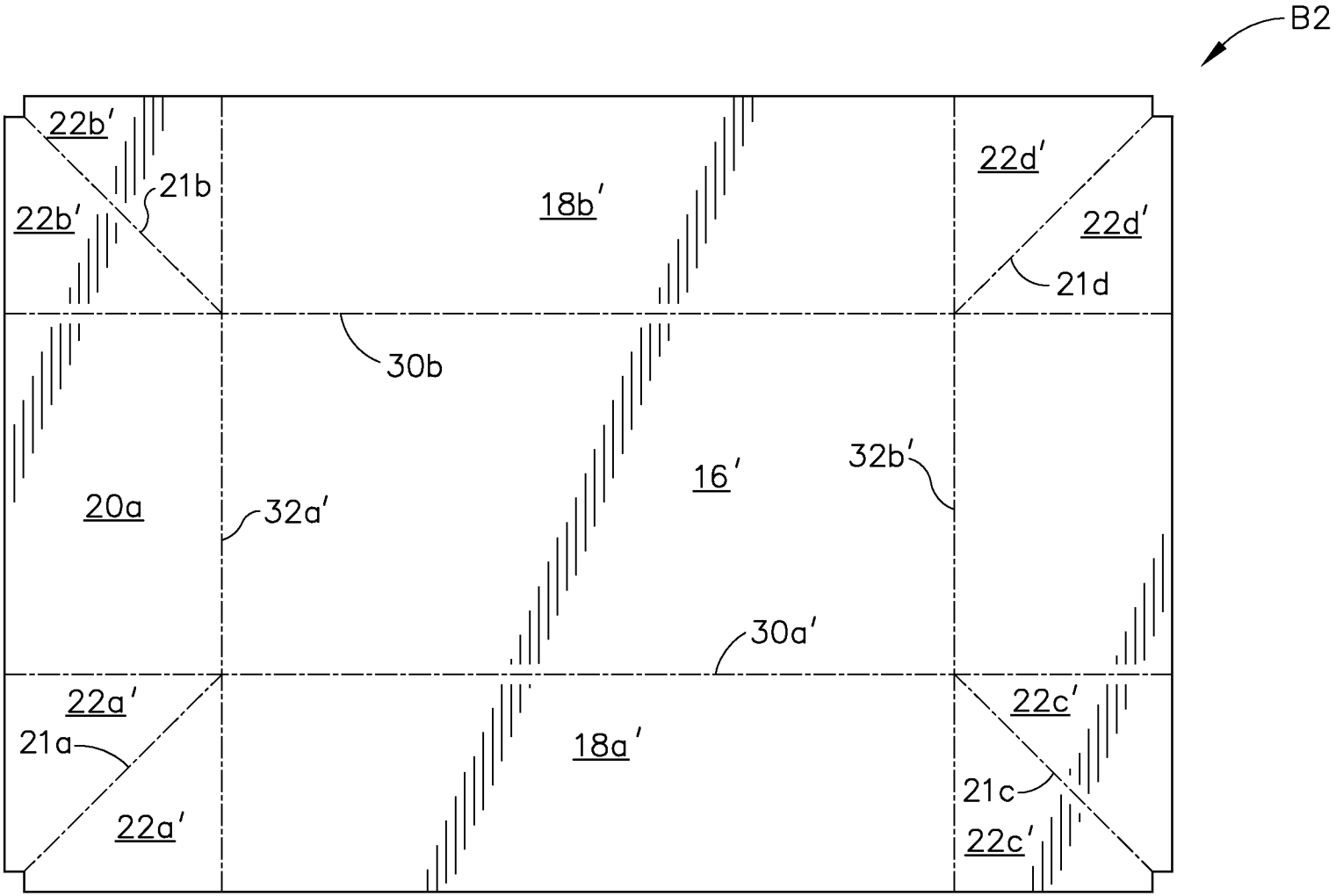
FIG. 4 is a top plan view of a blank B2 for making the base portion of container in FIG. 1 in accordance to a preferred embodiment of the present invention.

FIG. 4 is a top plan view of a blank B2 for making the base portion 12 of container in FIG. 1 in accordance to a preferred embodiment of the present invention. The blank B2 is the same as blank B1 except that the blank B2 does not have the score or crease line 15 on its side walls and it is slightly smaller in size so that when the blank B2 is fully constructed, the lid 14 can be telescopically fit over the base 12. The blank B2 is preferably an integral piece of a material such as continuous sheet of conventional corrugated cardboard. The blank B2 is cut along its outer margins to form its specific shape of a gusseted design style tray or base 12 when fully constructed. The blank B2 is divided into bottom wall panel 16', side wall panels 18*a*', 18*b*', end wall panels 20*a*', 20*b*', and joined flaps 22*a*', 22*b*' and 22*c*', 22*d*' by two longitudinal parallel fold lines 30*a*', 30*b*', and two lateral parallel fold lines 32*a*', 32*b*' intersecting one another. Each of the joined flaps 22*a*', 22*b*' and 22*c*', 22*d*' is further divided by respective diagonal fold lines 21*a*', 21*b*', 21*c*', and 21*d*' which permits each flaps folds onto itself to form a respective gusset when the blank B2 is fully constructed. Although the blank B2 is characterized as having side panels and end panels, but one of the ordinary skilled in the art would appreciate that the end panels can be defined as side panels as well and the characterization of the side panels and end panels have no effect on the function or utility of the blank B1. The Blank B2 is formed from a corrugation medium 34 sandwiched between two liner boards 36*a*, 36*b* as seen best in FIG. 6 as will be discussed hereinafter.

Figure 5A:
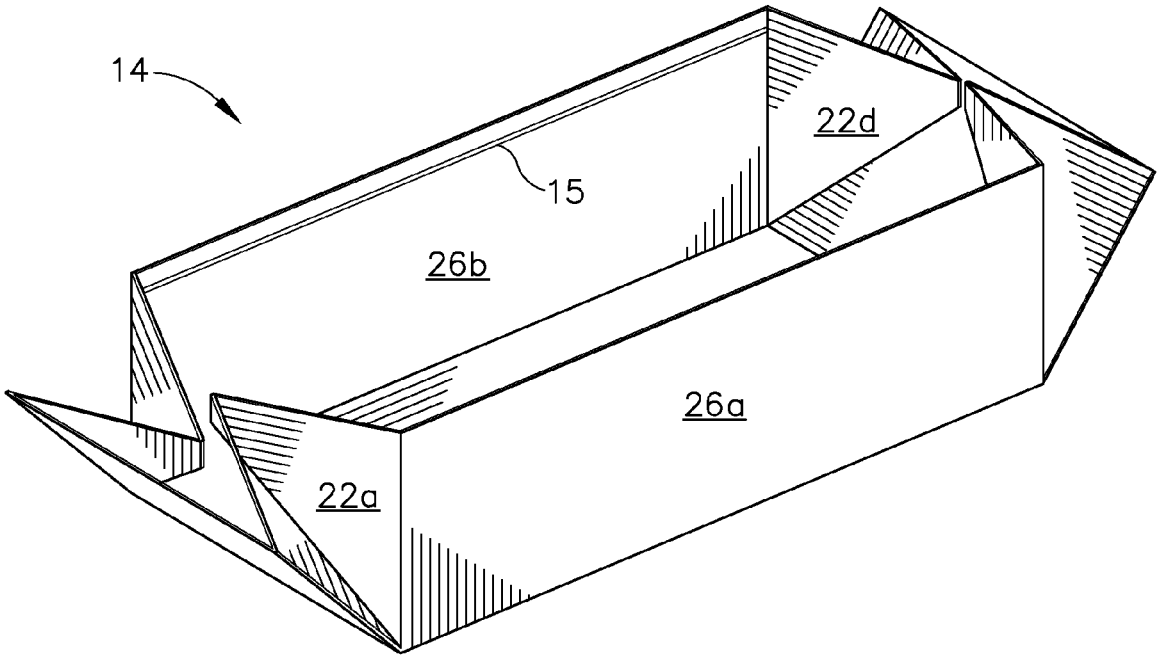
FIGS. 5A & 5B are respective partially constructed and fully constructed blank B1 for making the lid portion of container.
Figure 5B:
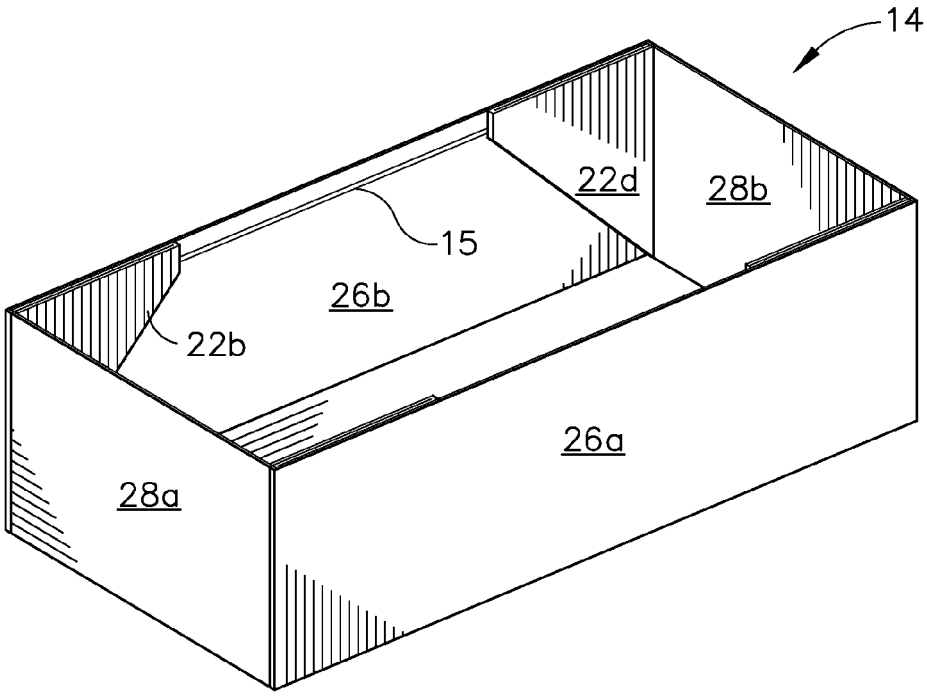

In use, the manual set-up of the blank B1 and blank B2 is easily accomplished. However, a person of ordinary skilled in the art would appreciate that generally a folding machine may alternatively perform the forming operations. Since the folding sequences for both blanks B1 and B2 are the same, therefore only folding sequence of blank B1 is described hereinafter. Referring to FIGS. 5A & 5B which FIG. 5A is partially constructed and FIG. 5B is fully constructed blank B1 for making the lid of container 10. After die cutting the blank B1 at the converting plant, the blank B1 is laid horizontally and respective side walls 26*a*, 26*b* are folded upwardly at right angle along fold lines 30*a*, 30*b*. Next, joined flaps 22*a*', 22*b*' and 22*c*', 22*d*' are folded with respect to its diagonal fold line 21*a*, 21*b*, 21*c*, 21*d* and which simultaneously brings respective end walls 28*a*', 28*b*' in a respective plane that is substantially perpendicular to the top wall panel 24. Finally, each of the joint flaps 22*a*', 22*b*' and 22*c*', 22*d*' are now formed as gusset that is attached to the respective side walls 26*a*, 26*b* of the lid 14. The joined flaps 22*a*', 22*b*' and 22*c*', 22*d*' are attached to the side walls 26*a*, 26*b* by staple or glue or the likes.

Figure 7:
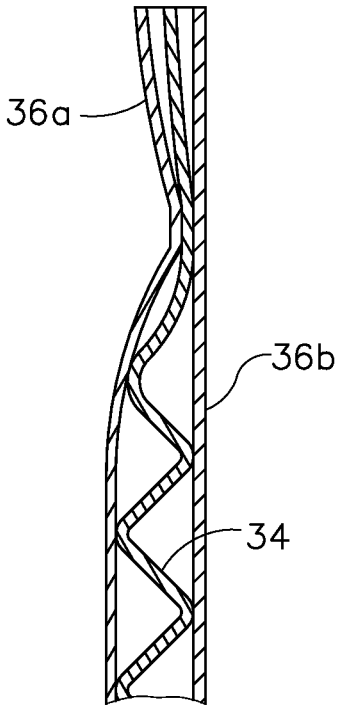
FIG. 7 is an enlarged cross section taken along lines 6-6 of one of edges of the lid portion depicting the score, crease or crushed point of the liners.

FIG. 6 is a top perspective view of the lid in FIG. 5 with a portion of lid 14 is removed to illustrate a score or crease 15 is formed perpendicular to the flutes near the edge of the lid to prevent water traveling up through the corrugation medium 34 when the container 10 is sitting in standing water and FIG. 7 is an enlarged view of the cross section taken along lines 6-6 of one of edges of the lid 14 depicting the crease or crushed line 15 forms a pinch point when liners 36*a* and 36*b* and the corrugation medium 34 are crushed with one another. The side walls 26*a*, 26*b* and 18*a*, 18*b* are made of Kraft poly film liners, such as Aquasafe® (International Paper Company) liners, with anti-wicking corrugation medium 34 positioned between the liners. The corrugation medium 34 is preferably made of a Climaguard® (International Paper Company) material. In operation, the waterproof, anti-wicking, and fully recyclable corrugated container 10 has waterproof liners 36*a*, 36*b* on the inner side and outer side of the walls of the container 10 to prevent liquids such as water from reaching the corrugation medium 34 from both inner and outer sides of liner boards 36*a*, 36*b*. The waterproof container 10 is particularly suitable for products such as fish or shrimp and the like and can be in contact with standing water for an extended time or otherwise in a very wet and harsh environment. For example, when the waterproof container 10 is placed in a standing water, the pinch point in the side walls prevents the standing water to rise up as otherwise would have been the case under normal condition (without the pinch point) due to the hydraulic pressure of water, which the water seeks its own level. It should be noted that the height of standing water should be almost half of the height of the lid side walls since the higher pressure of the water may adversely affect the integrity of the crush line 15 along the side walls of the lid 14.

The waterproof, anti-wicking, and recyclable corrugated paperboard container 10 of the present invention avoids the drawbacks of prior art containers, including general structural weakness, loose fitting top cover and can withstand very wet and harsh weather. The inventive container 10 has a small footprint when transported or stored empty and folds up or can be assembled rapidly without the use of tools.

What is claimed is:

1. A waterproof, anti-wicking, and fully recyclable corrugated container comprising:

a base portion having a bottom wall, a pair of opposite side walls, a pair of opposite end walls, and a plurality of joined flaps foldably joined with the side walls and the end walls wherein the each of the plurality of the joined flaps folds onto itself to form a gusset that is attached to the respective side walls; and a lid portion telescopically engaged over the base portion the lid having a top wall, a pair of opposite side walls, a pair of opposite end walls, and a plurality of joined flaps foldably joined with the side walls and the end walls wherein the each of the plurality of the joined flaps folds onto itself to form a gusset that is attached to the respective side walls of the lid, the lid portion comprises a score or crease line formed along near and spaced from free edge of the side walls to inhibit liquid from traveling up through the side walls.

2. The corrugated container of claim 1 wherein each of the side walls of the lid is defined by a corrugation medium adhesively interposed inner and outer liners.

3. A waterproof, anti-wicking, and fully recyclable corrugated container comprising:

a base portion having a bottom wall, a pair of opposite side walls, a pair of opposite end walls, and a plurality of joined flaps foldably joined with the side walls and the end walls wherein the each of the plurality of the joined flaps folds onto itself to form a gusset that is attached to the respective side walls; and a lid portion telescopically engaged over the base portion the lid having a top wall, a pair of opposite side walls, a pair of opposite end walls, and a plurality of joined flaps foldably joined with the side walls and the end walls wherein the each of the plurality of the joined flaps folds onto itself to form a gusset that is attached to the respective side walls of the lid, each of the side walls being defined by a corrugation medium adhesively interposed inner and outer liners wherein the lid portion comprises a score or crease line formed along near and spaced from free edge of the inner liner to substantially crush the inner liner against the corrugation medium so as to inhibit water from traveling up through height of the side walls.

* * * * *